United States Patent [19]

Simonoff

[11] 4,085,464

[45] Apr. 25, 1978

[54] DOUBLE OVEN MITT

[75] Inventor: Ely Simonoff, Wheeling, Ill.

[73] Assignee: Opelika Manufacturing Corporation, Chicago, Ill.

[21] Appl. No.: 739,281

[22] Filed: Nov. 5, 1976

[51] Int. Cl.[2] ..... A41D 25/00

[52] U.S. Cl. ..... 2/158

[58] Field of Search ..... 2/158, 159, 160

[56] References Cited

U.S. PATENT DOCUMENTS

| | | | |
|---|---|---|---|
| 542,823 | 7/1895 | Farnam | 2/158 |
| 2,773,264 | 12/1956 | Nover | 2/159 |

FOREIGN PATENT DOCUMENTS

| | | | |
|---|---|---|---|
| 829,472 | 7/1958 | United Kingdom | 2/158 |

*Primary Examiner*—Doris L. Troutman
*Attorney, Agent, or Firm*—Richard G. Lione

[57] ABSTRACT

A double oven mitt which is fabricated of flexible heat-resistant material and comprises a band elongated on an axis which connects a pair of mitts for receiving the left and right hands of a wearer. Each of the mitts includes a thumb portion extending substantially parallel to the connecting band axis and a finger portion inclined downwardly at an angle to the axis of the thumb portion and connecting band. The finger portion folds about a line inwardly under a dish being grasped by the wearer to support the dish flat on its bottom without bunching up or otherwise distorting to prevent the wearer's grip from being uncomfortable and jeopardizing safe-handling of the dish.

2 Claims, 2 Drawing Figures

FIG. 1
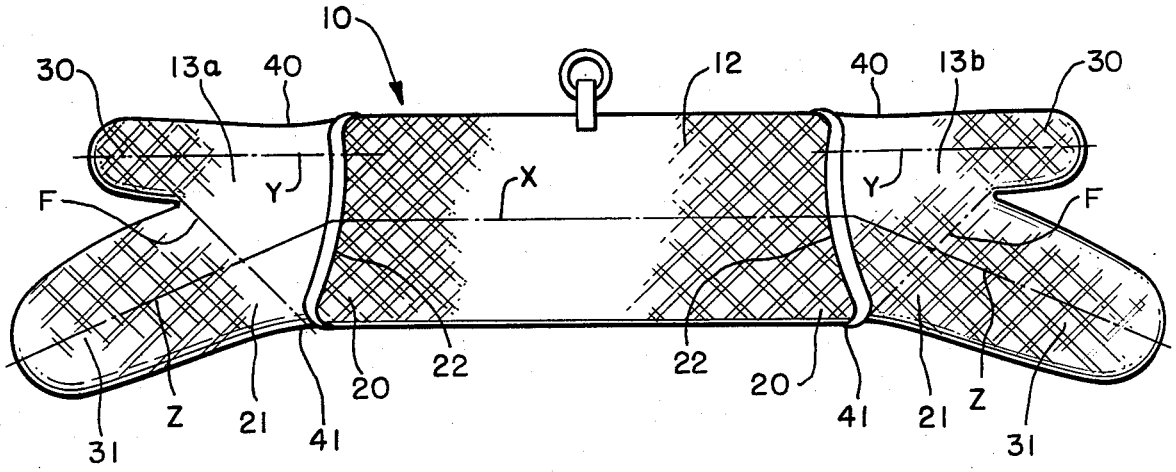
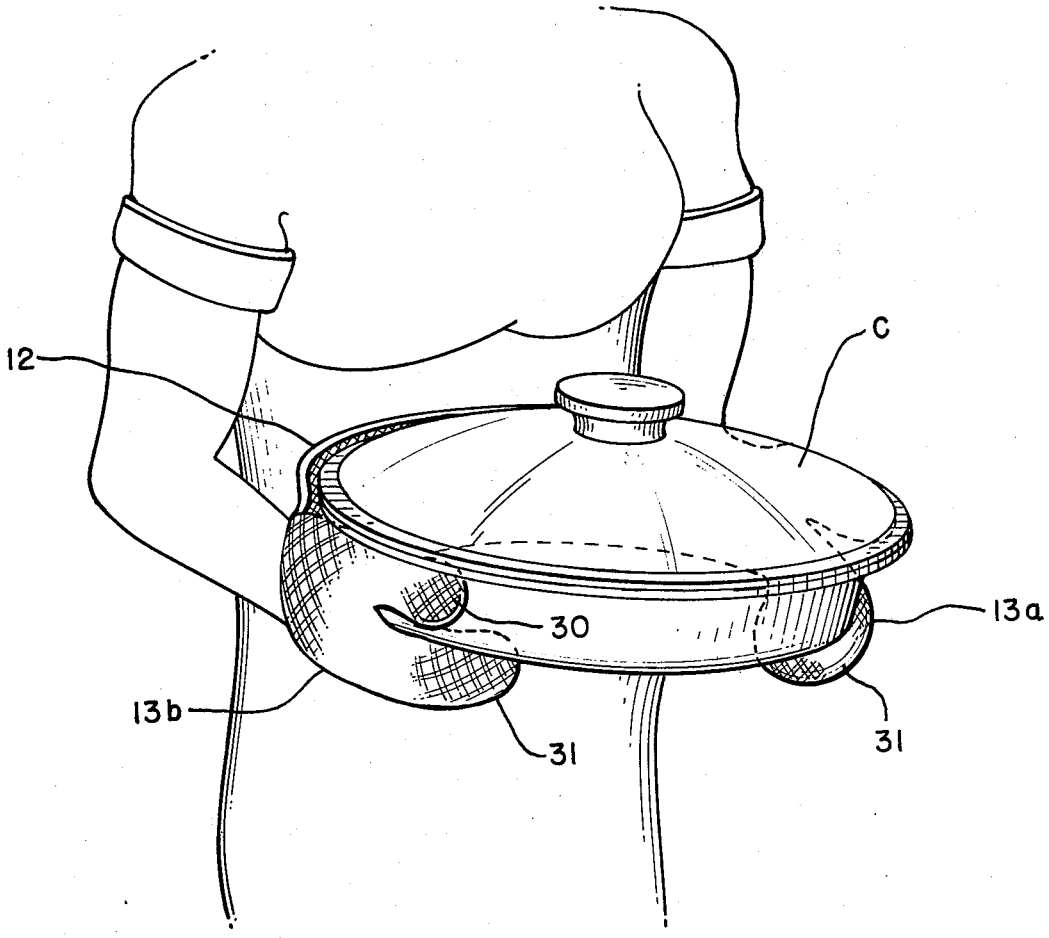
FIG. 2

DOUBLE OVEN MITT

FIELD OF THE INVENTION

This invention is in the field of wearing apparel. It relates particularly to mittens for protecting a wearer's hands.

BACKGROUND OF THE INVENTION

Mittens or mitts are widely used to protect a wearer's hands from all types of deleterious substances and conditions. One such product is the well-known oven mitt for handling hot containers or utensils in the kitchen.

An oven mitt is normally designed for use on one hand. However, so-called double oven mitts are known, as illustrated in British Pat. No. 829,472. The latter finds particularly advantageous application in the handling of large oven dishes such as casseroles. The present invention is concerned with a new and improved "double oven mitt" construction.

SUMMARY OF THE INVENTION

The double oven mitt construction embodying the present invention facilitates easily grasping and holding a hot casserole dish, for example, more securely and safely than heretofore found possible with prior art oven mitts such as disclosed in the aforementioned British patent.

In a double oven mitt fabricated of heavy, heatresistant material, the construction of the invention provides left and right hand mitts formed at opposite ends of a connecting band. The band is straight and as wide as the opening to each mitt. Each mitt includes a thumb portion and a finger portion.

According to the invention, the axis of each thumb portion extends parallel to the axis of the connecting band. In contrast, the axis of each finger portion is inclined downwardly at an angle of approximately 23° to the axes of the thumb portions and connecting band.

In use, the aforedescribed construction of the invention provides specific, advantageous and unobvious results. The connecting band wraps on the circumference of a casserole dish as the user reaches in opposite directions around the dish. The thumb portions lie parallel to and immediately under the lip of the dish, permitting the lip to rest on the thumbs while they exert radial inward pressure on the side of the dish to grasp it firmly. At the same time, the finger portions fold inwardly and under the dish on a line inclined at 45° to the axis of the band and thumb portions. The user's fingers in the finger portions bend in unconstricted fashion into flat and full support of the dish on its bottom.

BRIEF DESCRIPTION OF THE DRAWING

The invention, including its construction and method of operation, together with additional objects and advantages thereof, is illustrated more or less diagrammatically in the drawing, in which:

FIG. 1 is a front elevational view of a double oven mitt embodying features of the invention; and FIG. 2 is a perspective view of a user wearing the double oven mitt of the invention in gripping a hot casserole dish.

DESCRIPTION OF THE PREFERRED EMBODIMENT

Referring now to the drawing, and particularly to FIG. 1, a double oven mitt embodying features of the present invention is illustrated generally at 10. The mitt 10 is manufactured of multiple layers of fabric sewn together over heavier layers of heatinsulating filling material. This construction results in a relatively thick, quilted material which is somewhat stiff.

The mitt 10 includes a center band 12 which connects opposite end hand mitts **13*a* and 13*b*. The connecting band 12 is 13 inches long and 6 inches wide and extends straight along a longitudinal axis X. The connecting band 12** comprises a single thickness of quilted material.

The mitts **13*a* and 13*b* are mirror images of each other. Each is made up of a double layer of quilted material so as to form pockets for the hands. The inner layer 20 of each mitt is a continuation of the connecting bank 12. The outer layer 21 is a separate layer and terminates along a reinforced edge 22** which defines the opening to each mitt.

Each mitt **13*a* and 13*b*, in turn, includes a thumb portion 30 and a finger portion 31. The thumb portion 30 is formed co-extensive with the upper edge 40 of the mitt. The axis Y of each thumb portion 30 is parallel to the axis X of the connecting bank 12**.

The finger portions 31, on the other hand, are formed in downwardly inclined attitudes (see FIG. 1) relative to corresponding thumb portions 30. According to the invention, the axis Z of each finger portion 31 is inclined downwardly at an angle of approximately 23° to the axis Y of the corresponding thumb portion 30.

The mitt 10 construction of the present invention aids greatly in the simple and safe handling of hot casserole dishes, for example. Referring to FIG. 2 as well as to FIG. 1, the wearer puts his or her hands into the mitts **13*a* and 13*b* in a well-known manner and draws them apart, thus extending the center band 12. The wearer reaches around the casserole dish C so that the thumb portions 30 in each mitt 13*a* and 13*b*** underlie the upper lip of the casserole dish.

The casserole dish can then be raised off the oven rack, for example, by applying pressure to the thumbs and palms of the user's hands. The center portion connecting bank 12 also bears tightly against the side of the casserole dish in this relationship, enhancing the wearer's grip on the dish.

With the casserole dish raised up off the oven rack, the downwardly inclined finger portions 31 of each mitt **13*a* and 13*b* are folded inwardly by the wearer's fingers along a line F which is inclined at 45° to the axes of the thumb portions 30 and the center band 12. The line F is disposed at an angle of 45° in a direction opposite to the downward angle of inclination of the finger portions 31, however, as will be noted. This line F extends approximately from the base of each thumb portion 30 to the lower edge 41 of the connecting band 12** at its juncture with each mitt opening. Folding most effectively in this manner, the finger portion of each mitt lies flat against the bottom of the casserole dish, supporting it safely and securely, without distorting bunching of the material, for example, which could jeopardize safe handling.

The casserole dish may then be moved rapidly in complete safety. The wearer's grip is comfortable and secure.

While the embodiment described herein is at present considered to be preferred, it is understood that various modifications and improvements may be made therein, and it is intended to cover in the appended claims all such modifications and improvements as fall within the true spirit and scope of the invention.

What is desired to be claimed and secured by Letters Patent of the United States is:

1. A double oven mitt fabricated of flexible heat-resistant material for handling a dish with an upper lip, comprising:

a. a pair of end hand mitts for receiving the left and right hands of a wearer, and b. a band elongated on an axis and connecting said end hand mitts whereby the palm of each of said mitts is an extension of said band, c. each of said end hand mitts including a thumb portion and a finger portion, wherein said thumb portion is formed coextensive the upper edge of said mitt, d. the axis of each of said thumb portions normally extending substantially parallel to said connecting band axis, e. the axis of each of said finger portions normally inclined downwardly at an angle to the axis of a corresponding thumb portion and the axis of said connecting band whereby each of said finger portions fold about a line in the palm of a correpsonding end hand mitt inwardly under a dish being grasped by the wearer to support the dish flat on its bottom without bunching up or otherwise distorting to prevent the wearer's grip from being uncomfortable and jeopardizing safe handling of the dish while said band engages and supports the circumference of the dish and said thumb portions and band underlie the upper lip of the dish.

2. the double oven mitt of claim 1 further characterized in that:

a. the axis of each of said finger portions is normally inclined downwardly relative to the axis of a corresponding thumb portion and said connecting bank at an angle of approximately 23°, and b. said line of folding of said finger portions is inclined upwardly at an angle of approximately 45° to the axes of said thumb portions and said connecting band.

* * * * *